US007938720B2

(12) United States Patent
Watkins

(10) Patent No.: US 7,938,720 B2
(45) Date of Patent: May 10, 2011

(54) METHOD AND APPARATUS FOR PRESENTING BINGO GAMING RESULTS USING MULTIPLE PRIZE DISTRIBUTIONS

(75) Inventor: Brian Alexander Watkins, Austin, TX (US)

(73) Assignee: Multimedia Games, Inc., Austin, TX (US)

( * ) Notice: Subject to any disclaimer, the term of this patent is extended or adjusted under 35 U.S.C. 154(b) by 463 days.

(21) Appl. No.: 11/531,222

(22) Filed: Sep. 12, 2006

(65) Prior Publication Data

US 2007/0060290 A1 Mar. 15, 2007

Related U.S. Application Data

(60) Provisional application No. 60/716,748, filed on Sep. 13, 2005.

(51) Int. Cl.
*A63F 3/06* (2006.01)

(52) U.S. Cl. ..... 463/19

(58) Field of Classification Search ..... 463/19, 463/22, 23

See application file for complete search history.

(56) References Cited

U.S. PATENT DOCUMENTS 4,657,256 A 4/1987 Okada
4,679,143 A 7/1987 Hagiwara
4,747,600 A 5/1988 Richardson
5,067,712 A 11/1991 Georgilas
5,370,399 A 12/1994 Liverance
5,833,538 A 11/1998 Weiss
5,935,002 A * 8/1999 Falciglia ..... 463/19
6,068,552 A 5/2000 Walker et al.
6,155,925 A 12/2000 Giobbi et al.
6,328,648 B1 12/2001 Walker et al.
6,394,902 B1 5/2002 Glavich et al.
6,581,935 B1 * 6/2003 Odom ..... 273/269
6,733,385 B1 5/2004 Enzminger et al.
6,805,349 B2 10/2004 Baerlocher et al.
6,923,721 B2 8/2005 Luciano et al.
2001/0009865 A1 * 7/2001 Demar et al. ..... 463/20

(Continued)

OTHER PUBLICATIONS

International Search Report for PCT/US2006/35536 dated Apr. 20, 2007 (3 Pages).

(Continued)

*Primary Examiner* — James S McClellan
*Assistant Examiner* — Allen Chan
(74) *Attorney, Agent, or Firm* — Russell D. Culbertson; The Culbertson Group, P.C.

(57) ABSTRACT

A method includes operating a bingo player station in a first play mode in which the result for a respective bingo game play initiated through the bingo player station is assigned according to a first pattern list. In response to detecting a trigger event, the bingo player station is switched from the first play mode to a second play mode and then the bingo player station is operated in this second play mode. In the second play mode, the result for a respective bingo game play initiated through the bingo player station is assigned according to a second pattern list. The bingo player station is switched from the second play mode to the first play mode in response to a return event. Both the first pattern list and the second pattern list may share at least one result level and at least one common result indicator. However, the two pattern lists are different so that a given bingo pattern correlated to a prize in one of the pattern maps may correlate to a different prize or no prize in the other pattern map.

25 Claims, 7 Drawing Sheets

U.S. PATENT DOCUMENTS

| | | | | |
|---|---|---|---|---|
| 2003/0008705 | A1 | 1/2003 | Baerlocher et al. | |
| 2003/0211878 | A1 * | 11/2003 | Walker et al. | 463/13 |
| 2004/0048647 | A1 | 3/2004 | Lind et al. | |
| 2004/0048652 | A1 | 3/2004 | Ching et al. | |
| 2004/0116174 | A1 | 6/2004 | Baerlocher et al. | |
| 2004/0152499 | A1 | 8/2004 | Lind et al. | |
| 2004/0185932 | A1 | 9/2004 | Lombardo | |
| 2004/0235551 | A1 | 11/2004 | Walker et al. | |
| 2004/0235555 | A1 | 11/2004 | Yarbrough et al. | |
| 2005/0059468 | A1 * | 3/2005 | Cannon | 463/19 |
| 2005/0130730 | A1 | 6/2005 | Lind et al. | |
| 2005/0137010 | A1 | 6/2005 | Enzminger et al. | |
| 2005/0164772 | A1 | 7/2005 | Lind et al. | |

OTHER PUBLICATIONS

Written Opinion of the International Search Authority (PCT Rule 43bis. 1) for PCT/US2006/35536 dated Apr. 20, 2007 (3 Pages).

* cited by examiner

| 401 RESULT LEVEL | 402 PATTERN SET | 403 RESULT INDICATOR | 404 RESULT VALUE |
|---|---|---|---|
| 0 | P1 | S1 | V0 |
| 1 | P2 | S2 | V1 |
| 2 | P3 | S3 | V2 |
| 3 | P4 | S4 | V3 |
| 4 | P5, P6 | S5 | V4 |
| 5 | P7, P8, P9 | S6-SX | V5 |
| 6 | P10, P11 | SY-SZ | V6 |
| 7 | OTHERS | OTHERS | V7 |

FIG. 4

| 501 RESULT LEVEL | 502 PATTERN SET | 503 RESULT INDICATOR | 504 RESULT VALUE |
|---|---|---|---|
| 0 | P1 | S1 | V0 |
| 1 | P2 | S2 | V1 |
| 2 | P3, P12 | S3 | V2 |
| 3 | P4, P13 | S4 | V3 |
| 4 | P5, P6, P14 | S5 | V4 |
| 5 | P7, P8, P15 | S6-SX | V5 |
| 6 | P10, P11, P16 | SY-SZ | V6 |
| 7 | OTHERS | OTHERS | V7 |

FIG. 5

METHOD AND APPARATUS FOR PRESENTING BINGO GAMING RESULTS USING MULTIPLE PRIZE DISTRIBUTIONS

CROSS-REFERENCE TO RELATED APPLICATION

The Applicants claim the benefit, under 35 U.S.C. §119(e), of U.S. Provisional Patent Application No. 60/716,748 filed Sep. 13, 2005, and entitled "SYSTEM FOR PRESENTING GAMING RESULTS IN A MULTIPLE PRIZE DISTRIBUTION FORMAT." The entire content of this provisional application is incorporated herein by this reference.

A portion of the disclosure of this patent document contains material which is subject to copyright protection. The copyright owner has no objection to the facsimile reproduction by any one of the patent document or the patent disclosure, as it appears in the Patent and Trademark Office patent file or records, but otherwise reserves all rights of copyright.

TECHNICAL FIELD OF THE INVENTION

This invention relates to bingo gaming systems and to gaming machines used to present bingo gaming results. More particularly, the invention relates to methods for presenting bingo gaming results to a player through a bingo player station using two different prize distributions for plays in the underlying bingo games.

BACKGROUND OF THE INVENTION

A large number of different gaming machines have been developed to provide various formats and graphic presentations for conducting games and presenting game results. For example, numerous mechanical reel-type gaming machines, also known as slot machines, have been developed with different reel configurations, reel symbols, and paylines. More recently, gaming machines have been developed with video monitors that are used to produce simulations of mechanical spinning reels. These video-based gaming machines may use one or more video monitors to provide a wide variety of graphic effects in addition to simulated spinning reels, and may also provide secondary/bonus games using different reel arrangements or entirely different graphics. Video-based gaming machines may also be used to show card games or various types of competitions such as simulated horse races in which wagers may be placed. Game manufacturers are continuously pressed to develop new game formats and game graphics in an attempt to provide high entertainment value for players and thereby attract and keep players.

Both mechanical reel gaming machines and video-based gaming machines may be used to present a bingo game result to a player who has initiated a play in a bingo game. When used in the conduct of bingo games, these gaming machines may be referred to as "bingo player stations." A bingo player at one of these bingo player stations may initiate a play in a bingo game using a player input arrangement associated with the particular bingo player station, and the result of the play in the bingo game is displayed at the bingo player station using the result display arrangement associated with the bingo player station. For example, where the bingo player station is a mechanical reel device, the mechanical reel(s) provide the result display arrangement and the various results in the bingo game may be correlated to reel stop positions. Continuing with this example, a straight line pattern may be defined as a winning result in the underlying bingo game, and this winning result may be displayed through the mechanical reel display as some number of a particular symbol aligned along a payline defined through the various reel symbol locations visible when two or more reels are caused to stop spinning. Alternatively, the stop position of a single mechanical reel may be used to represent a result in the underlying bingo game. A video-based reel-type game may present a bingo game result in a similar fashion. Video-based gaming machines may also serve as a bingo player station by showing a bingo result as a result in a card game. For example, a straight line bingo pattern achieved in the underlying bingo game may be displayed to the player as a poker hand of three of a kind or some other hand value. Regardless of the manner in which the bingo game result is shown to the player at the bingo player station, the result is ultimately identified from the play of an underlying bingo game. That is, the bingo game play initiated through the bingo player station is associated with a bingo card or a data structure representing such a card, and this bingo card/card representation is entered in a bingo game conducted in the bingo gaming system. The result of the bingo game play is represented by the manner in which the various bingo numbers (or other designations) used in the bingo game match the bingo numbers (or other designations) associated with the respective bingo card/card representation.

U.S. patent application publication No. 2004-0048647-A1 discloses an arrangement for mapping various result levels to various sets of bingo patterns to produce a desired prize distribution for a bingo game. This arrangement allows bingo probabilities, that is, the probabilities associated with achieving various bingo patterns in a bingo game, to be used to produce a prize distribution that is, for example, characteristic of a standard mechanical or video-based reel-type game. Thus, applying bingo pattern mapping as disclosed in U.S. patent application publication No. 2004-0048647-A1, allows the play of bingo at a bingo player station to imitate the play of a traditional gaming machine in which the results are determined in some random fashion to produce a target prize distribution.

It is known in traditional gaming machines to modify the prize distribution for a given game in order to make the game more exciting for the player. In particular, U.S. Pat. No. 5,833,538 to Weiss discloses a traditional reel-type gaming machine which can be modified in the course of play to change the likelihood of hitting a winning combination of reel symbols on a given play. However, the Weiss patent relates to traditional reel-type gaming machines and does not disclose any arrangement for presenting results from bingo games or modifying the likelihood of any given result presented at a bingo player station.

SUMMARY OF THE INVENTION

The present invention includes a highly entertaining method of presenting bingo game results. The entertainment value is achieved by using two or more different modes of play, with each mode associated with its own unique characteristics of play in terms of the probabilities of winning various prizes. The invention includes operating a bingo player station in a first play mode and then periodically switching temporarily to a second play mode. The present invention also encompasses both a gaming apparatus and program products for implementing methods according to the invention.

A method embodying principles of the invention may be implemented in a bingo player station using one or more display devices such as CRTs, LCDs, plasma displays, or other types of display devices. The display device or devices are used to show graphic elements according to the invention. Alternatively, the present invention may be implemented with a bingo player station that includes an arrangement of one or more mechanical reels to show the various graphic elements. As used in this disclosure and the accompanying claims, a bingo player station through which the present invention may be implemented will be referred to generally as a bingo player station regardless of the nature of the display arrangement used in the device to show results to the bingo player.

One preferred method embodying the principles of the invention includes operating a bingo player station in a first play mode in which the result for a respective bingo game play initiated through the bingo player station is assigned according to a first pattern list. In response to detecting a trigger event, this illustrative method includes switching the bingo player station from the first play mode to a second play mode and operating the bingo player station in this second play mode. In the second play mode, the result for a respective bingo game play initiated through the bingo player station is assigned according to a second pattern list. The method further includes switching the bingo player station from the second play mode to the first play mode in response to a return event.

The first pattern list by which results are assigned in the above-described method includes a number of first result levels with each first result level corresponding to a respective set of one or more bingo patterns, and to one or more first result indicators. These "result indicators" are each an arrangement of one or more graphic symbols or devices that correspond to a respective prize or other result for a play in a bingo game. Similar to the first pattern list, the second pattern list includes a number of second result levels, each second result level corresponding to a respective set of one or more bingo patterns, and to one or more second result indicators. However, the second pattern list is different from the first pattern list so that a given bingo pattern correlated to a prize in the second pattern list may correspond to a different prize or no prize in the first pattern list, and/or a given bingo pattern correlated to a prize in the first pattern list may map to a different prize or no prize in the second pattern list. Regardless of the differences between the first pattern list and the second pattern list, the two pattern lists may share at least one result indicator, and preferably two or more result indicators. That is, the first pattern list includes a first result level corresponding to a particular first result indicator, and the second pattern list includes a second result level corresponding to a second result indicator that is substantially the same as the particular first result indicator. In some preferred forms of the invention, the two pattern lists share several result indicators, or even all result indicators. In other forms of the invention, the two pattern lists may not share any result indicators.

The use of different play modes and different pattern lists in the above-described method enables the characteristics of play at a bingo player station to be modified in the course of play to produce a desired affect. For example, the first mode of play at a bingo player station may correspond to a regular mode of play with a given win distribution, and the second mode of play may correspond to a "hot mode" of play in which the win distribution is more favorable to the player. By "more favorable to the player" it is meant that the player wins more frequently with the hot mode of play and/or wins larger prizes. Furthermore, by using shared result indicators between the two pattern lists, the game presentation at the bingo player station may remain the same or at least partially the same regardless of the play mode in effect for a given play initiated at the bingo player station.

One preferred bingo gaming apparatus according to the invention includes a display device and a player input device associated with a bingo player station. This preferred bingo gaming apparatus also includes a presentation controller which may or may not be located at the bingo player station and a display controller which also may or may not be located at the bingo player station. The display controller is responsible for directing the display device to produce a suitable result indicator to show a result for a respective bingo game play initiated at the bingo player station. The presentation controller is responsible for assigning results according to the pattern lists described above. In particular, the presentation controller applies the first pattern list to assign a result for a respective bingo game play initiated through the player input device when the bingo player station is in the first play mode. The presentation controller also applies the second pattern list to assign a result for a respective bingo game play initiated through the player input device when the bingo player station is in the second play mode. The presentation controller also selectively switches between the first play mode and the second play mode. As in the method described above, the first pattern list includes a number of first result levels with each first result level corresponding to a respective set of one or more bingo patterns and to one or more first result indicators, and the second pattern list includes a number of second result levels with each second result level corresponding to a respective set of one or more bingo patterns and to one or more second result indicators. Also similarly to the preferred method described above, the first and second pattern lists are different from one another, and the first pattern list and second pattern list share at least one common result indicator.

A program product embodying the principles of the invention includes first play mode program code, second play mode program code, and play mode control program code. The first play mode program code is executable to cause a bingo player station to operate in the first play mode as described above, while the second play mode program code is executable to cause the bingo player station to operate in the second play mode as described above. The play mode control program code is executable to cause the bingo player station to switch from the first play mode to the second play mode in response to a trigger event and to cause the bingo player station to switch from the second play mode to the first play mode in response to a return event.

These and other advantages and features of the invention will be apparent from the following description of preferred embodiments, considered along with the accompanying drawings.

BRIEF DESCRIPTION OF THE DRAWINGS

FIG. 4 is a representation of a first pattern list as employed in the present invention.

FIG. 5 is a representation of a second pattern list as employed in the present invention.

DESCRIPTION OF PREFERRED EMBODIMENTS

The claims at the end of this document set out novel features which the Applicant believes are characteristic of the invention. The various advantages and features of the invention together with preferred modes of use of the invention will best be understood by reference to the following description of illustrative embodiments read in conjunction with the drawings introduced above.

Figure 1:
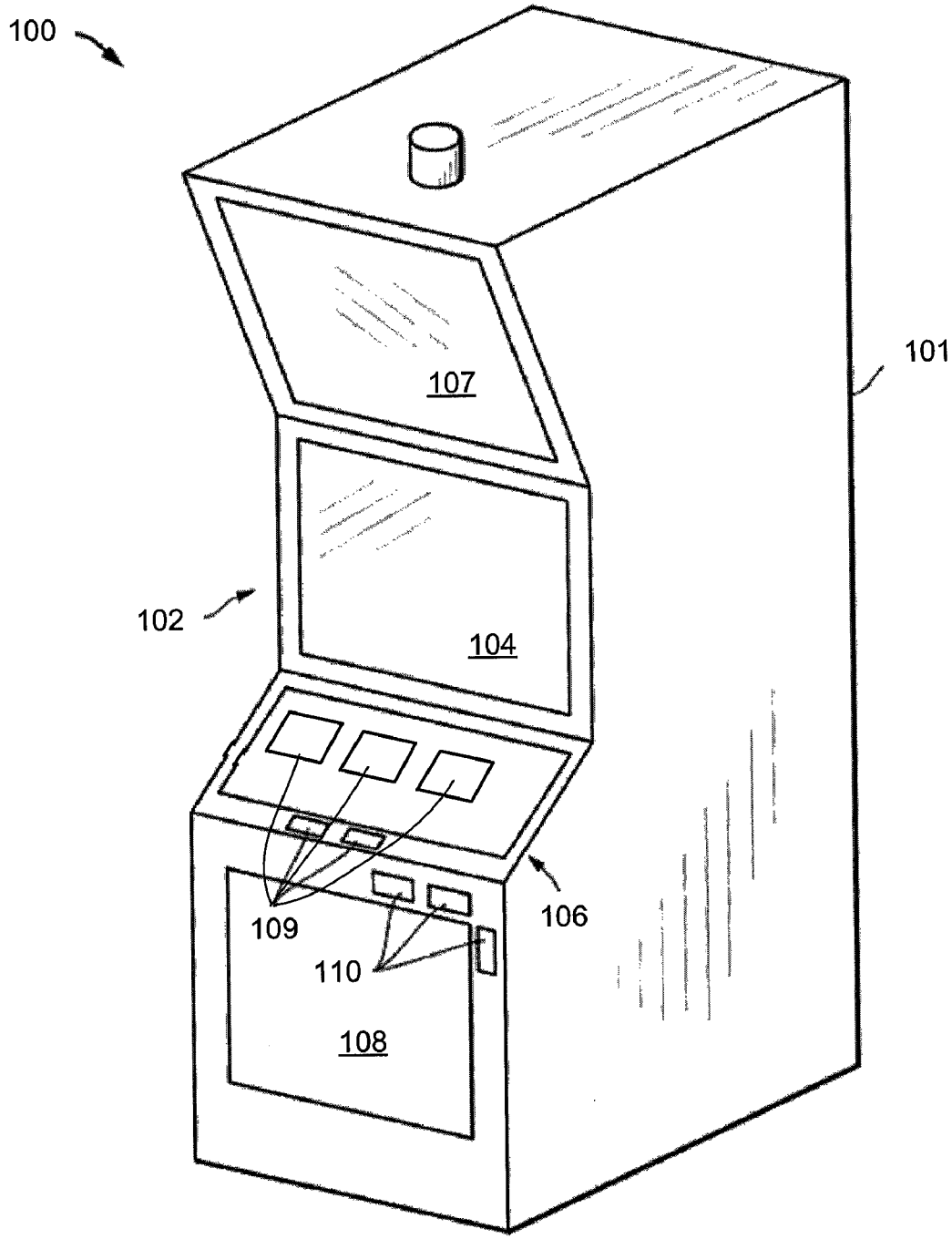
FIG. 1 is a perspective view of a bingo player station that may be used to present bingo gaming results to a bingo player according to the present invention.
Figure 2:
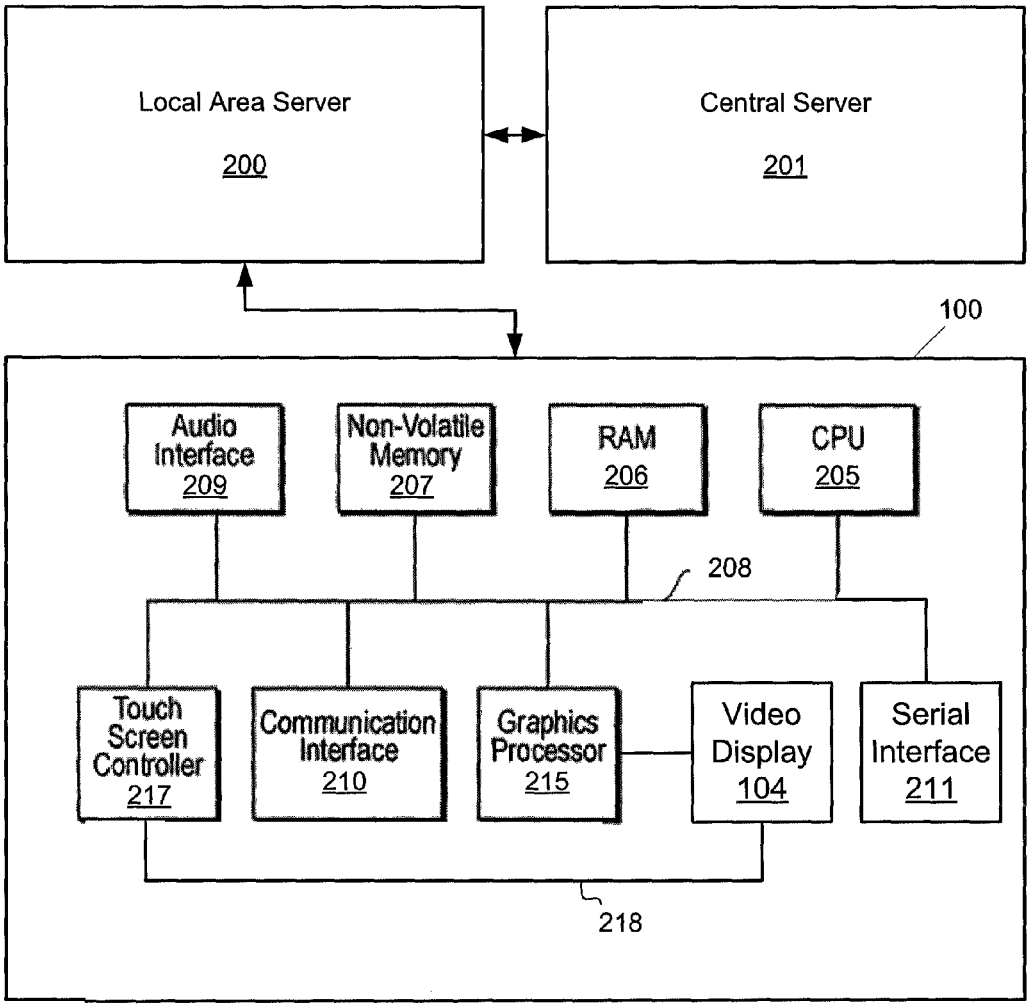
FIG. 2 is a diagrammatic representation of a bingo player station and bingo gaming system that may be used to implement methods according to the present invention.

FIG. 1 shows a bingo player station 100 that may be used to present bingo game results according to the present invention. The block diagram of FIG. 2 shows further details of bingo player station 100 connected in a gaming system in which the present invention may be used to present gaming results to players.

Referring to FIG. 1, a bingo player station 100 includes a cabinet 101 having a front side generally shown at reference numeral 102. A video display device 104 is mounted in a central portion of the front surface 102, with a ledge 106 positioned below the video display device and projecting forwardly from the plane of the video display device. In addition to the video display device 104, the illustrated bingo player station includes a top glass display 107 positioned above the video display device, and a belly glass display 108 positioned below the video display device. Video display device 104 may be used to produce the graphic components making up a result indicator for a given play initiated through bingo player station 100. For example, video display 104 may be used to show a reel-type graphic display such as that shown in FIG. 6 and such as that shown in FIG. 7, in which the result of each play is shown as a particular combination of reel symbols aligned along a payline. Top glass display 107 and bottom glass display 108 may be used to show static graphics related to the result indicating graphics for the game. For example, top glass display 107 may show a paytable such as the paytable described below in connection with FIG. 8, and bottom glass display 108 may show additional graphics related to the game played at bingo player station 100.

Bingo player station 100 illustrated in FIG. 1, includes mechanical player control buttons or other input devices 109 mounted on ledge 106. Other forms of the invention may include switches, joysticks, or other player input devices mounted on ledge 106.

Bingo player station 100 also includes additional player interface devices 110 on a lower portion of cabinet 101 generally in the plane of bottom glass display 108. These additional player interface devices 110 may comprise for example, a player card reader, a voucher or ticket reader/issuer, a currency acceptor/validator, and/or a coin or token acceptor/dispenser.

It should be noted that the present invention is by no means limited to implementation with a bingo player station having a single video display such as bingo player station 100 shown in FIG. 1. A bingo game result presentation arrangement according to the present invention may employ any bingo player station that includes a player interface for enabling a player to make direct inputs, and one or more video display devices, or physical reel arrangements through which the result indicators may be produced. Bingo player station 100 is merely shown as an example of a bingo player station through which the invention may be implemented. Other bingo player stations implementing the present invention may include other types of devices that may show bingo game play results. For example, a bingo player station may include a spinning wheel to show results. It should also be noted that the video display device 104 used in bingo player station 100, or some other bingo player station implementing the invention, may comprise any suitable video display device including a cathode ray tube, liquid crystal display, plasma display, LED display or any other type of video display currently known or that may be developed in the future.

FIG. 2 provides a block diagram showing various components of bingo player station 100 together with gaming system components external to the bingo player station. In particular, FIG. 2 shows bingo player station 100 connected for communication with a local area server 200 and a central server 201. Local area server 200 and central server 201 may be used together with bingo player station 100 and other bingo player stations to implement a bingo gaming system, such as the bingo gaming system described in U.S. patent application publication No. 2004-0152499-A1. Local area server 200 and central server 201, or both servers, may cooperate to identify results that are provided to bingo player station 100 in response to a bingo game play entered (initiated) at the bingo player station. That is, local area server 200 and/or central server 201, or more particularly, one or more processing devices associated with server 200 and/or server 201 may serve as a result controller for identifying bingo patterns achieved for a particular play in a bingo game. Local area server 200 and/or central server 201 may be used to provide player tracking and accounting services for the bingo player stations included in the gaming system.

The bingo player station 100 shown in FIG. 2 includes a central processing unit (CPU) 205 along with random access memory 206 and nonvolatile memory or storage device 207. All of these devices are connected on a system bus 208 with an audio interface device 209, communications interface 210, and a serial interface 211. A graphics processor 215 is also connected on bus 208 and is connected to drive the video display device 104 (mounted on cabinet 101 as shown in FIG. 1). As shown in FIG. 2, bingo player station 100 also includes a touch screen controller 217 connected to system bus 208. Touch screen controller 217 is also connected to receive signals from a touch screen element associated with video display device 104. It will be appreciated that the touch screen element itself comprises a thin film that is secured over the display surface of video display device 104. The touch screen element itself is not illustrated or referenced separately in the figures although the connection between the touch screen element and touch screen controller 217 is shown generally by line 218.

Those familiar with data processing devices and systems will appreciate that other basic components will be included in bingo player station 100 such as a power supply, cooling systems for the various system components, audio amplifiers and speakers, and other devices that are common in gaming machines. These additional devices are omitted from the drawings so as not to obscure the present invention in unnecessary detail.

All of the elements 205, 206, 207, 208, 209, 210, and 211 shown in FIG. 2 are elements commonly associated with a personal computer. These elements may be mounted on a standard personal computer chassis and housed in a standard personal computer housing which is itself mounted in cabinet 101 shown in FIG. 1. Alternatively, the various electronic components may be mounted on one or more circuit boards housed within cabinet 101 without a separate enclosure such as those found in personal computers. Those familiar with data processing systems and the various data processing elements shown in FIG. 2 will appreciate that many variations on this illustrated structure may be used within the scope of the present invention. For example, since serial communications are commonly employed between a main processing device for a computer system and a touch screen controller, a system according to the invention may include a touch screen controller that communicates with the system through serial interface 211. The serial interface 211 may be any suitable peripheral interface such as a USB controller or an IEEE 1394 controller. It will also be apparent to those familiar with personal computers that the various components shown in FIG. 2 may not be connected directly to system bus 208 as indicated in the figure. Rather, any of the devices shown in FIG. 2 may be connected directly to an intermediate bus which is connected to the system bus 208 through a suitable controller. For example, non-volatile memory/storage device 207 may be connected via a serial ATA controller, and audio interface 209 may be connected through a suitable expansion bus and expansion bus controller such as a PCI bus and PCI bus controller. Numerous other variations in the bingo player station internal structure and system may be used in accordance with the principles of the present invention.

It will also be appreciated that although separate graphics processor 215 is shown for controlling video display device 104, CPU 205 may control the video display device directly without any intermediate graphics processor. The invention is not limited to any particular arrangement of graphics processors for controlling the video display device or devices that may be included in the bingo player station.

In the illustrated bingo player station 100, CPU 205 executes software which ultimately controls the entire bingo player station including the receipt of player inputs and the presentation of the graphic symbols at the various symbol locations displayed according to the invention through the video display device 104 associated with the bingo player station. Thus, CPU 205 either alone or in combination with graphics processor 215 serves as the display controller according to the invention. CPU 205 by itself or in cooperation with one or more other processing devices may also serve as the presentation controller according to the invention. Where the bingo player station itself identifies bingo patterns for plays initiated at the bingo player station, CPU 205 also serves as a result controller, although pattern identification will commonly be performed at a more centralized processing device such as local area server 200 or central server 201 in a bingo gaming system. CPU 205 may also execute software to perform accounting functions associated with game play. Random access memory 206 provides memory for use by CPU 205 in executing its various software programs while the nonvolatile memory or storage device 207 provides storage for programs not in use or for other data generated or used in the course of operation of bingo player station 100. Communications interface 210 provides an interface to other components of a gaming system that may be involved in game play, such as local area server 200 and/or central server 201.

It should be noted that the invention is not limited to bingo player stations employing the personal computer-type arrangement of processing devices and interfaces shown in example bingo player station 100. Other bingo player stations may include one or more special purpose processing devices to perform the various processing steps for implementing the present invention. Unlike general purpose processing devices such as CPU 205, these special purpose processing devices may not employ operational program code to direct the various processing steps.

Figure 3:
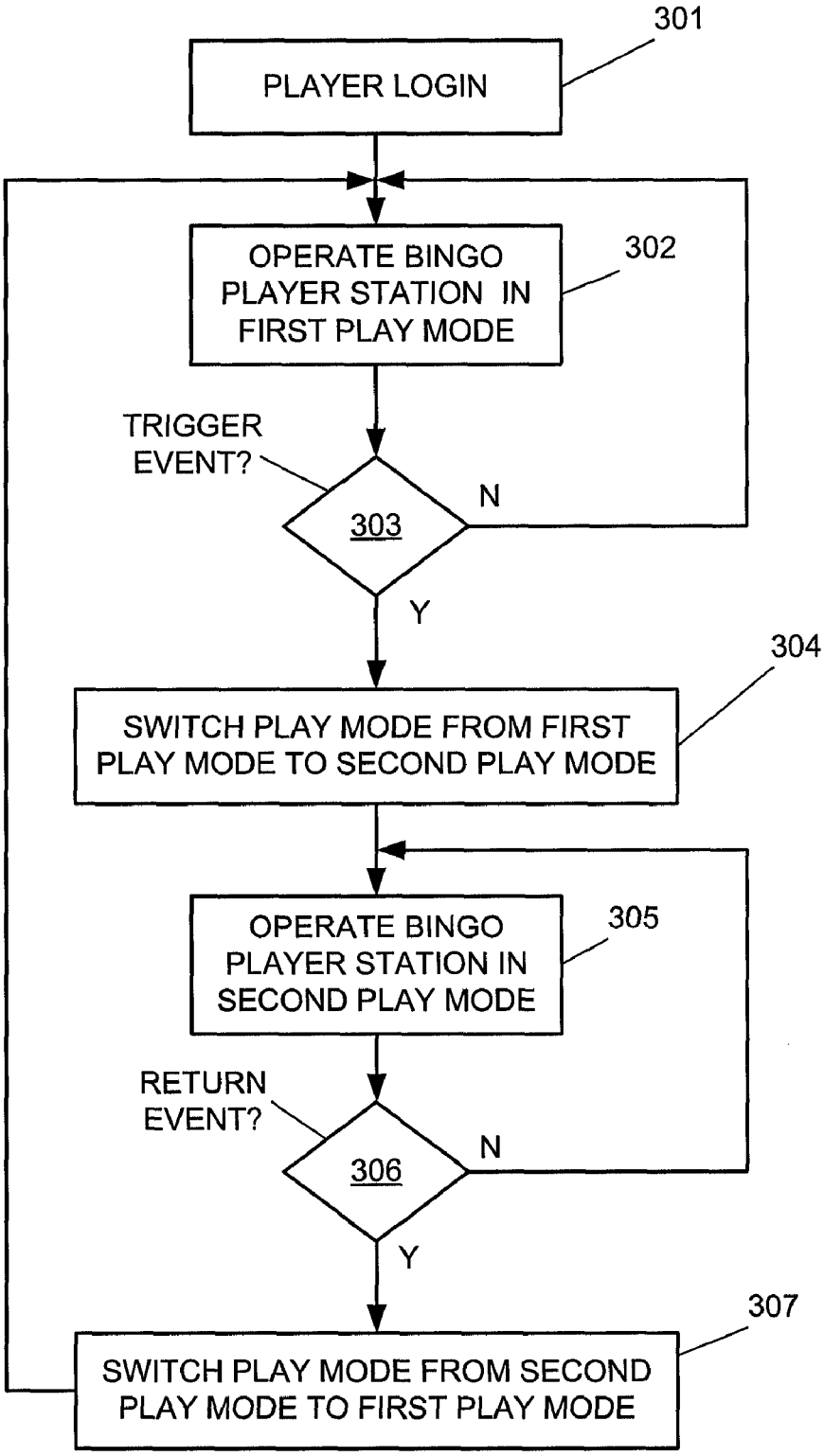
FIG. 3 is a flow chart showing a method embodying the principles of the present invention.

FIG. 3 comprises a process flow chart showing the operation of a bingo player station according to one form of the present invention. The bingo player station may be of the type shown as bingo player station 100 in FIGS. 1 and 2 for example. The process begins with a player login as shown at process block 301 in FIG. 3. The process continues with the bingo player station operating in a first play mode to present a bingo result to the player as indicated at process block 302. If a trigger event has not occurred as indicated by a negative result at decision block 303, then the process returns to a point above process block 302 and bingo player station continues to operate in the first mode of play. However, if a trigger event has occurred as indicated by a positive result at decision block 303, the mode of play switches from the first play mode to the second play mode as shown at process block 304, and the bingo player station begins operating in the second play mode as shown at process block 305. The process proceeds to identify whether a return event has occurred as shown at decision block 306. If a return event has not occurred, then the bingo player station continues to operate in the second play mode, or, if a return event has occurred, the mode of play switches back to first play mode as shown at process block 307.

The operation of the bingo player station as shown at process block 302 itself generally includes a series of steps representing a single game cycle to present a bingo game result to the player. The game cycle will typically include some player input representing a bingo game play request at the bingo player station to initiate a bingo game play. This input may be entered in any suitable fashion at the bingo player station and may include one or more separate inputs. For example, a particular bingo player station could require that a player make some input to select a bingo card to place in play, select a wager level, actually place the selected bingo card in play, and enter one or more daub inputs. All of these inputs are entered at a suitable input device at the bingo player station, such as one or more input devices 109 shown in FIG. 1 and/or a touch screen associated with a game display such as video display device 104 as discussed above in connection with FIG. 2. Other implementations of the invention employ a much more streamlined input procedure for initiating a bingo game play. For example, a given bingo game play may be initiated by simply activating a "play" button included in player input devices such as input devices 109 in FIG. 1 and/or included in a touchscreen display.

Regardless of the manner in which a bingo game play is initiated in a game cycle at process block 302 in FIG. 3, the bingo game play is ultimately associated with at least one bingo card or a data representation of such a card. The bingo card/card representation for a bingo game play is also ultimately matched to a series of bingo designations generated for the bingo game, and this matching may result in a pattern of matches for the bingo card/card representations. The pattern of matches achieved for a given bingo card/card representation is used to identify a bingo result for the card and associated bingo game play. In particular, various patterns of matched bingo card locations are correlated to various results in the bingo game through a pattern list such as the example pattern lists illustrated in FIGS. 4 and 5. The example pattern list shown in FIG. 4 corresponds to a first pattern list as described in the invention summary above, and is used to assign results for bingo game plays initiated while the bingo player station is operating in the first play mode as indicated at process block 302 in FIG. 3.

The example pattern list shown in FIG. 4 includes eight result levels, levels 0 through 7 in first column 401 labeled "Result Level." Each result level is correlated to one or more matched bingo card patterns indicated in the second column 402, one or more result indicators shown in column 403, and a result value shown in column 404. In the example pattern list shown in FIG. 4, patterns are represented by the labels P1 through P11, result indicators are represented by the labels S1 through SZ, and result values are represented by the labels V0 through V7. Each pattern P1 through P11 comprises a definition of a pattern of matched bingo card locations that may be achieved in the bingo game. For example, the bingo card may comprise a 5×5 grid of card locations and pattern P10 may be defined as the first column of five locations in the 5×5 grid, while pattern P11 may be defined as the last column of five locations in the 5×5 grid.

The designations X, Y, and Z in result indicator labels SX, SY, and SZ in FIG. 4 represent variables for numerical values. Thus, the designation "S6-SX" at result level 5 in column 403 of the pattern list shown in FIG. 4 is intended to indicate that some number of result indicators such as result indicators S6, S7, S8, etc. through SX are included in that pattern set. The designation "SY-SZ" at result level 6 in column 403 is intended to indicate that the pattern set correlated to that result level includes some number of result indicators such as result indicators SY, SY+1, SY+2, etc. through SZ. The invention is not limited to any particular number of result indicators at a given result level. Each result level may be correlated to a single result indicator, or some or all result levels may be correlated to multiple alternative result indicators for indicating that result for the play in the bingo game. At result level 7 in FIG. 4, the pattern set labeled "Others" refers to all other patterns not included in one of the other patterns sets, and the result indicator field labeled "Others" refers to all other result indicators other than those correlated to another result level. Typically, the result level in a pattern list corresponding to result level 7 shown in FIG. 4 correlates to a result value of zero, that is, a loss on the bingo game play.

In one preferred form of operation according to the invention, a result controller either located at the bingo player station (such as bingo player station 100 shown in FIGS. 1 and 2) or located at a local area server or central server (such as servers 200 and 201, respectively, in FIG. 2), identifies the matched pattern associated with a bingo card for a given bingo game play. The result controller communicates the identified pattern to a presentation controller in some suitable form, such as in the form of a code representing the identified pattern for example. The presentation controller applies the first pattern list to assign a result for the identified pattern and this result represents the result for the bingo game play initiated through the bingo player station while the player station is operating in the first play mode.

Although the pattern list may be applied in a number of fashions to assign the result, one preferred presentation controller queries the pattern list to identify the result level correlated to the identified pattern, and then reads the result value associated with that result level. The presentation controller also identifies a result indicator associated with that result level so that the display device associated with the bingo player station may be controlled to show a proper graphic to display the result to the player. This display of the result to the player will be described further below in connection with the example graphic display shown in FIG. 6. One preferred process for identifying a result indicator associated with a given result level includes reading a code or other identifier for a result indicator correlated to the given result level through a suitable data structure. This identifier may point to stored data which defines a given result indicator graphic. The stored data may be processed or otherwise used to cause a display device to generate the desired result indicator graphic. For example, a video display device such as device 104 may be directed by a processor or graphics processor to generate the desired result indicator graphic. Alternatively, a mechanical reel display device may be controlled by suitable reel position controllers to cause the reels to stop to show the desired result indicator symbol combination.

Referring again to the flow chart shown in FIG. 3, any suitable event may be employed as a trigger event which may be detected as indicated at decision block 303 to cause the bingo player station to switch from the first play mode to the second play mode as shown at process block 304. In one preferred form of the invention, three consecutive wins while the bingo player station is operating in the first play mode may represent a trigger event. Alternatively, any other event associated with one or more plays in the first play mode may be used as a trigger event. A certain matched pattern, result level, matched bingo card location, matched bingo card designation, or some number of consecutive losing plays, or any other characteristic associated with one or more plays in the first play mode may be used as a trigger event. Other forms of the invention may use some event unrelated to a play at the first play mode to represent a trigger event. For example, a trigger event for a given bingo player station may be generated randomly at the player station or elsewhere, or produced according to some schedule based on time or the number of plays at the bingo player station or some group of such player stations.

Regardless of the trigger event used in the decision indicated at decision block 303 in FIG. 3, the switching of modes indicated at process block 304 is preferably performed in response to a trigger event signal generated as appropriate for the particular trigger event. For example, where three wins in a row at the first play mode represent a trigger event, the bingo player station processor such as processor 205 in FIG. 2, or some other processing device such as local area server 200 or central server 201 includes a process that counts the number of consecutive wins and generates a trigger event signal when the desired number of consecutive wins occurs at the bingo player station. This trigger event signal, which may be a code or any other signal as appropriate to the processing device that generates the signal, is communicated to the apparatus component that serves as the presentation controller so that the presentation controller can switch modes at or for the particular bingo gaming machine. This switch is accomplished by switching from a first pattern list to a second pattern list for use in assigning results for the bingo game plays entered at the respective bingo player station.

FIG. 5 provides an example of a second pattern list according to the present invention. The example second pattern list shown in FIG. 5 is similar to the first pattern list shown in FIG. 4, and includes eight result levels, levels 0 through 7 in the "Result Level" column 501. Each result level is correlated to one or more matched bingo card patterns indicated in the second column 502, one or more result indicators shown in column 503, and a result value shown in column 504. It will be noted that the result indicators in column 503 of FIG. 5 and the result values shown in column 504 correspond exactly to the result indicators and result values shown in FIG. 4. This is not necessary for the present invention, but allows a single set of graphics and single paytable to be used for both play modes. The example second pattern list shown in FIG. 5 also employs some patterns in the "Pattern Set" column 502 which are also used in the first pattern list shown in FIG. 4. However, some of the result levels in FIG. 5 include additional patterns. For example, the result level "2" in FIG. 4 includes pattern "P3" and pattern "P12" whereas result level "2" in FIG. 5 includes just pattern "P3." The effect of including an additional pattern in result level "2" in FIG. 5 is that the probability of a player achieving that result level is increased with respect to the pattern list shown in FIG. 4. That is, if a player in the underlying bingo game achieves either pattern "P3" or pattern "P12" in the bingo game, the player will be awarded the prize associated with result level "2." Thus, the probability of obtaining result value "V2" for a bingo game play initiated when the second play mode is in effect is greater than the probability of obtaining result value "V2" when the bingo player station is operated in the first play mode. The probability of achieving result levels "3," "4," and "6" are also each increased by the addition of patterns at each result level. It will be noted that result level "5" is correlated to patterns "P7," "P8," and "P15" in FIG. 5, and is correlated to patterns "P7," "P8," and "P9" in FIG. 4. The substitution of patterns in this fashion may increase or decrease the probability of achieving that result level.

The process of operating the bingo player station in the second play mode as indicated at process block 305 in FIG. 3 may be substantially the same as the operation described above in connection with process block 302. However, rather than employing the first pattern list shown in FIG. 4 to assign results for the respective play, the presentation controller employs the second pattern list shown in FIG. 5 when operating in the second play mode. Because the probability of obtaining a result at least at one result level in the second pattern list is different from the corresponding result level in the first pattern list, the expected result distribution in the second mode of play is different from the expected result distribution in the first mode of play. Although the second mode of play may be less favorable to the player than the first mode of play, preferred forms of the present invention, and the form illustrated using FIG. 5, makes the second mode of play more favorable to the player for at least result levels "2," "3," "4," and "6."

All of the variations described above in connection with the trigger event are also applicable to the return event which results in the bingo player station switching from the second play mode back to the first play mode. Regardless of the specific event or series of events that may be chosen to serve as a return event, an appropriate component at the bingo player station or elsewhere preferably generates a suitable return event signal and communicates the return event signal as necessary to the system component serving as the presentation controller. The presentation controller then responds to the return event signal by switching the mode of play from the second play mode to the first play mode as indicated at process block 307 in FIG. 3. The switch back to the first play mode is accomplished according to the invention by switching back to the first pattern list for use in assigning results for subsequent bingo game plays initiated prior to the next trigger event.

Figure 6:
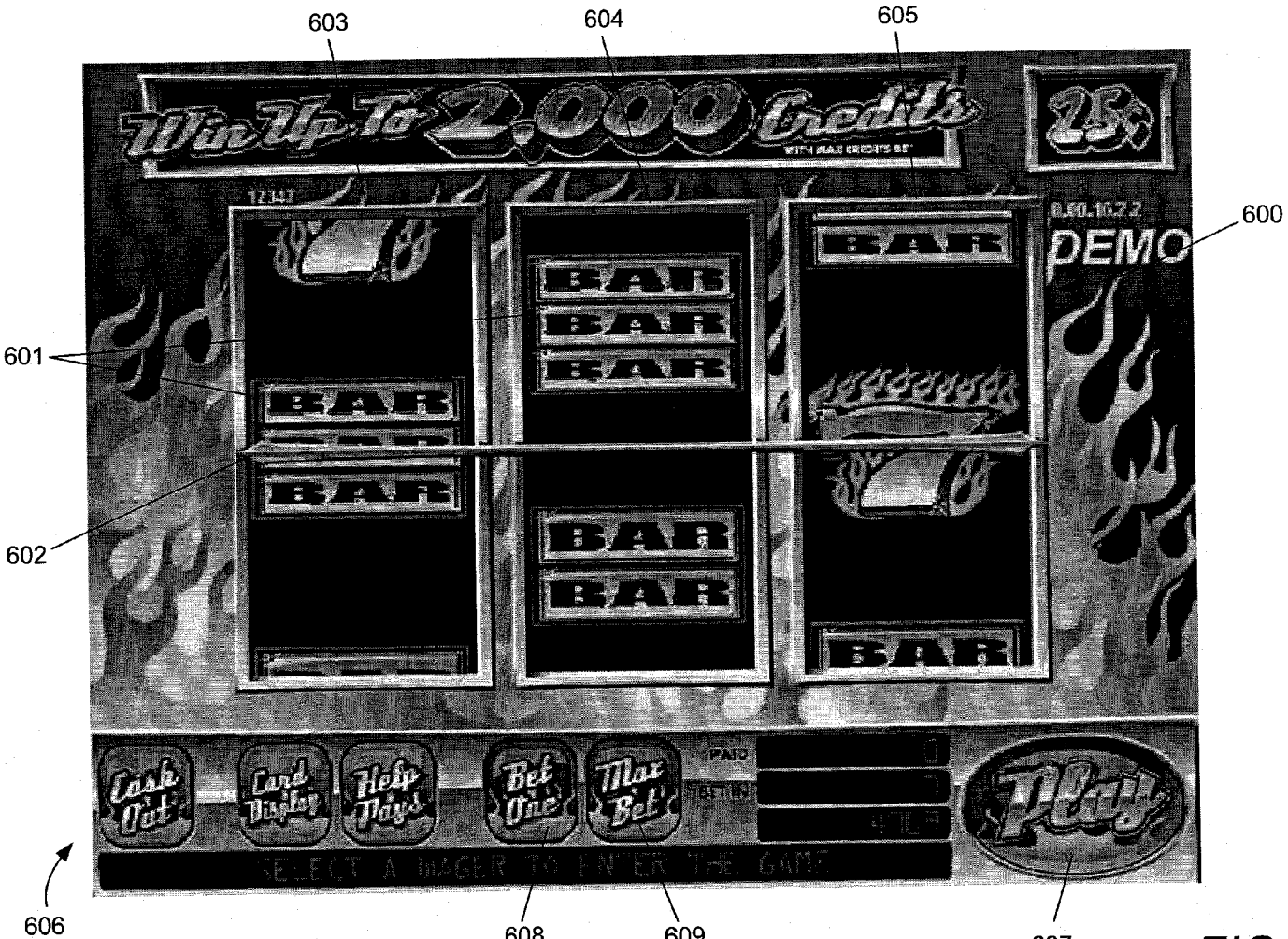
FIG. 6 is a representation of a graphic display that may be generated to display a bingo game result at a bingo player station operating in the first play mode.

FIG. 6 shows a representation of a graphic display 600 that may be produced in a method embodying the principles of the invention when the bingo player station is operating in the first play mode. The graphic display shown in FIG. 6 is a video reel-type display that includes a number of reel symbols 601. Such a graphic display may be generated on a video display device such as video display device 104 shown in FIGS. 1 and 2 in connection with example bingo player station 100. The reel symbols 601 are arranged vertically in columns 603, 604, and 605, and each column simulates a spinnable reel such as the mechanical reel on a mechanical reel-type machine (slot machine). A payline 602 is defined through the matrix of reel symbols shown in the three columns 603, 604, and 605. A result in a given bingo game play initiated through a bingo player station employing graphic display 600 is shown by first causing the simulated reels defined by columns 603, 604, and 605 to appear to spin and then come to rest with a particular set of reel symbols 601 and/or blanks lined up along payline 602. The reel symbols 601 that line up along this payline indicate the result for the bingo game play. As will be discussed below in connection with FIG. 8, the correlation of certain reel symbol combinations to prize values is preferably shown in a paytable displayed at the bingo player station. Regardless of how the correlation between reel symbol combinations and prize values is shown, the reel symbol combinations represent result indicators in accordance with the present invention.

In addition to graphic display 600, the video device used to generate the graphic display image also provides additional graphic elements around the periphery of the graphic display 600. In particular, icons or touch screen elements shown generally in area 606 are included in the example shown in FIG. 6, and may be used to facilitate player inputs in the course of play at the bingo player station. "Play" button 607, may be invoked by a player to initiate a bingo game play at the bingo player station. "Bet One" and "Max Bet" buttons 608 and 609, respectively, may also be invoked to choose a bet level in the process of initiating a bingo game play at the bingo player station employing graphic display 600. FIG. 6 also shows other player control touch screen buttons/icons "Cash Out," "Card Display," and "Help Pays" to invoke other common functions available in bingo player stations and other types of gaming machines.

Figure 7:
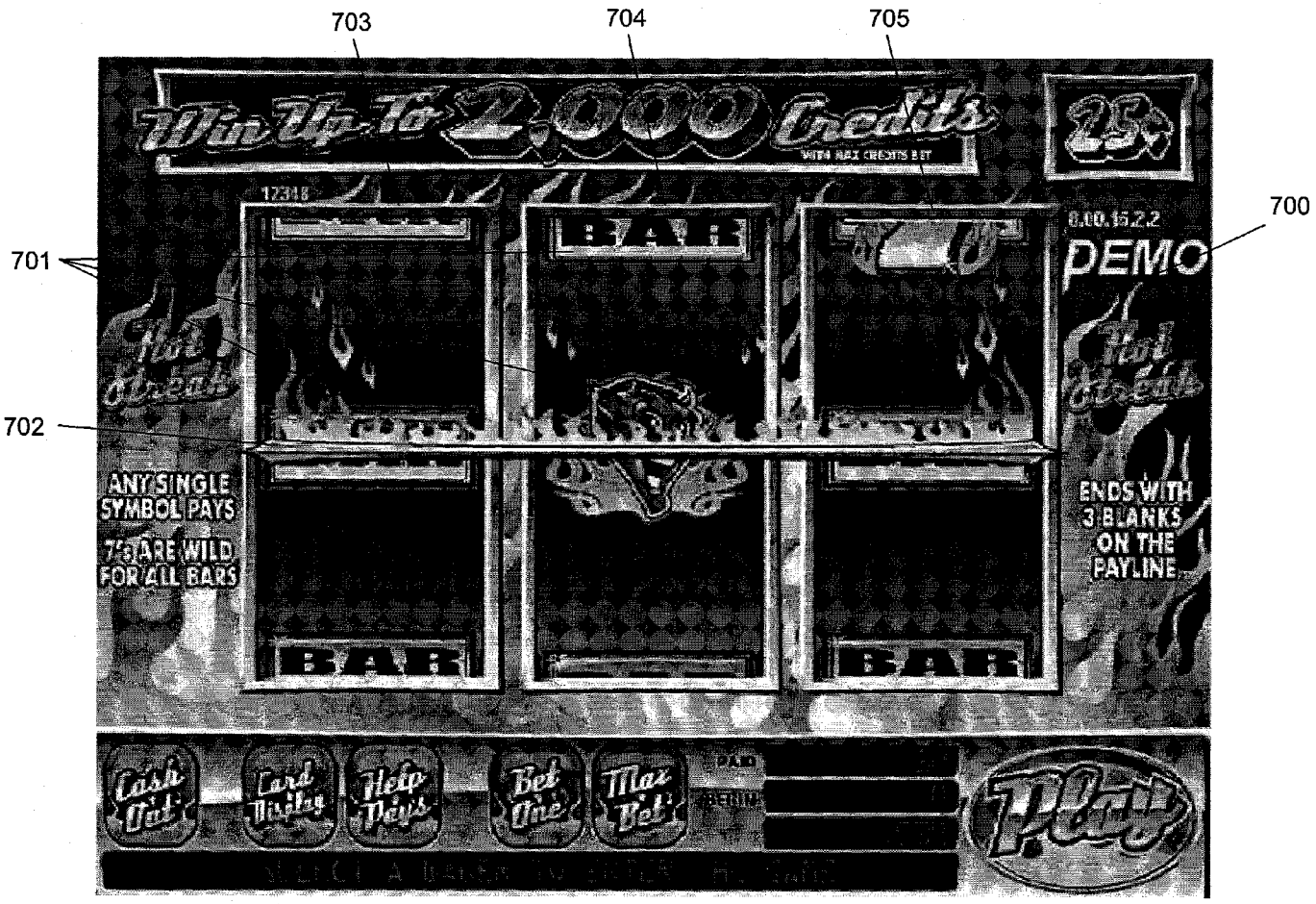
FIG. 7 is a representation of a graphic display that may be generated to display a bingo gaming result at a bingo player station operating in the second play mode according to the invention.

FIG. 7 shows a representation of a graphic display 700 that may be produced when the bingo player station (such as bingo player station 100 shown in FIGS. 1 and 2) is operating in the second play mode according to the present invention. Graphic display 700 is similar to graphic display 600 with a number of reel symbols 701 arranged in three columns 703, 704, and 705, each representing a spinnable reel. Payline 702 is defined along the middle of each column/simulated reel 703, 704, and 705. Additional graphic elements are included in this particular example graphic display 700 to indicate to the player that the bingo player station is operating in the second play mode. These additional graphic elements, which are facilitated by the use of a video display to generate graphic display 700, include flames appearing along payline 702, the additional text "Hot Streak," and further textual information located peripherally to the reel simulations of graphic display 700. This textual information will be described further below in connection with the paytable shown in FIG. 8.

Figure 8:
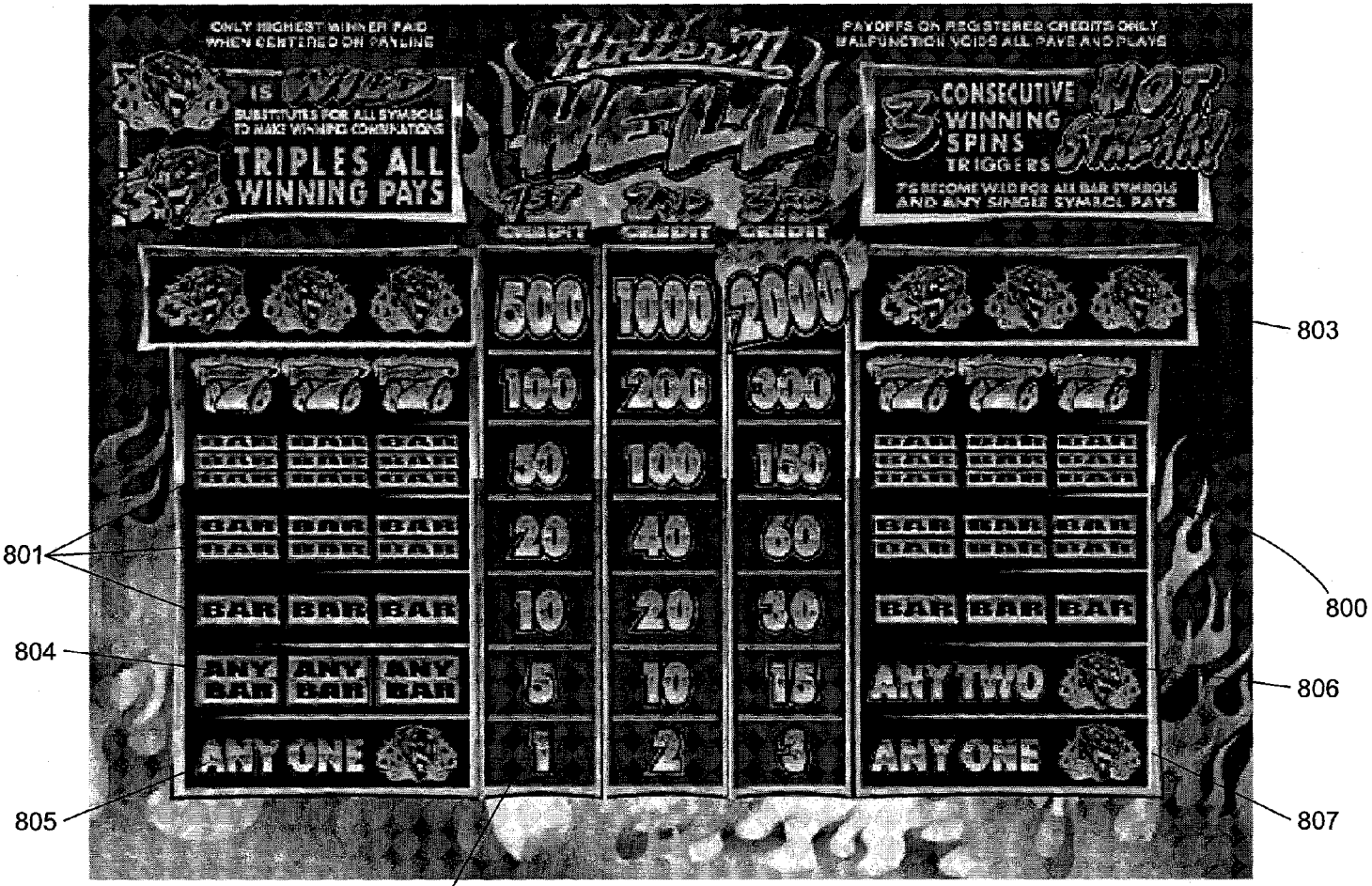
FIG. 8 is a representation of a paytable that correlates result indicators with various prizes in the graphic displays shown in FIGS. 6 and 7.

FIG. 8 shows a representation of a paytable 800 that may be employed for the graphic display 600 shown in FIG. 6 and graphic display 700 shown in FIG. 7. The paytable 800 graphically correlates prizes 802 with certain reel symbol combinations 801 that may be aligned along a payline such as payline 602 in FIG. 6 and payline 702 in FIG. 7. For example, the reel combination of three "7" symbols shown in FIG. 8 indicates a prize of 100 credits on a 1 credit wager, 200 credits on a 2 credit wager, and 300 credits on a 3 credit wager. Thus, the reel combinations shown in FIG. 8 each represent a result indicator, and, more particularly, a winning result indicator. These reel combinations/result indicators correspond to the result indicators described above in connection with the pattern lists shown in FIGS. 4 and 5. For example, result level 0 in FIGS. 4 and 5 may correspond to the top prize level shown in paytable 800 in FIG. 8. In this case the result indicator S1 shown in FIGS. 4 and 5 would comprise the combination of devil reel symbols shown at 803 in FIG. 8. The example paytable shown in FIG. 8 also shows how multiple result indicators may be correlated to a single result level. Specifically, the result indicators shown at 804, 805, 806, and 807 in FIG. 8 indicate that numerous different combinations of reel symbols may represent winning result indicators at the corresponding result levels.

Paytable 800 may define winning result indicators for results in both the first play mode and the second play mode. That is, the winning symbol combinations/winning result indicators 801 shown in FIG. 8 represent both first result indicators for results of play in the first play mode and second result indicators for results of play in the second play mode. However, in other implementations of the invention, the first and second result indicators may be substantially different. Preferred forms of the present invention include at least one result indicator that is common between the two play modes/pattern lists. It will be noted that even in the example display graphic and result indicator arrangement shown in FIGS. 6 through 8, there are some differences between the result indicators for the second play mode as compared to the first play mode. For example, the added text relating to the second play mode shown in FIG. 7 indicates that in addition to the result indicators shown in paytable 800, any symbol 701 that appears along payline 702 indicates an award has been won by the player, and thus that any arrangement of at least one reel symbol 701 along payline 702 represents a winning result indicator. This has the effect of also modifying the result indicator necessary in the second play mode to indicate a losing result to the player, that is, a result in the underlying bingo game that is not associated with a prize. In particular, given the rule that any symbol aligned along payline 702 represents a winning result, the only way in the second play mode to indicate a losing result is to show three blanks aligned along payline 702.

The return event for the example shown in FIGS. 6 through 8 is simply a loss in the second play mode. That is, in the event that the bingo card associated with a bingo game play initiated at the bingo player station in the second play mode produces a pattern that is not correlated to any winning result in the second pattern list, that result in the bingo game is considered a return event and results in the bingo player station being switched back to the first play mode as indicated at process block 307 in FIG. 3.

The example displays shown in FIGS. 6 and 7, and the paytable shown in FIG. 8, are shown only as convenient examples for describing the principles of the invention. Many variations on these basic examples may be employed within the scope of the present invention. In particular, the invention is not limited to any particular manner for displaying the results for the game play. It will be appreciated that although the example graphic display shown in FIG. 6 is well suited for implementation in a video format with a bingo player station such as bingo player station 100 shown in FIGS. 1 and 2, the game results may be displayed using a mechanical reel gaming machine. Other graphic displays may include more or fewer spinning reels or reel simulations, one or more different paylines, or non-reel arrangements for showing game results, such as playing card hands and simulated horse or dog races, for example. Furthermore, other forms of the present invention may allow only a single bet level and may not provide different prizes based on different wager/bet levels. Where multiple bet levels are available such as those indicated in paytable 800 shown in FIG. 8, the invention still preferably uses a single pattern list for each respective play mode. However, multiple result values will be associated with each result level, each result value corresponding to a respective bet level. Information on the bet level for a given bingo game play may be used in connection with the pattern list to select the correct result value corresponding to the bet level.

It should be noted that restrictions may be placed on bet levels available in play modes that are more favorable to the player. In particular, a bingo player station implementing the present invention may be programmed or otherwise operated to prevent a player from increasing their bet level when play is switched to a play mode that is more favorable to the player. In one arrangement for preventing an increase of bet levels in a more player-favorable play mode, the presentation controller may take an increased bet level in a player-favorable play mode as a return event to cause play to switch back to the less favorable play mode. The player may be warned through a display such as video display 104 in FIG. 2, before switching back to the less favorable play mode, and allowed an opportunity to withdraw the increased bet. Alternatively, the bingo player station may simply not accept an input that attempts to increase the bet level in the more player-favorable play mode, and/or may lock the bet level in to the bet level in effect at the time of the trigger event for all bingo game plays initiated in the more player-favorable play mode.

In forms of the invention implemented through general purpose processing devices such as the devices shown in the example bingo player station 100 of FIG. 2, the various steps shown in FIG. 3 are performed under the control of operational program code. One preferred form of the invention executes first play mode program code to cause bingo player station 100 to operate in the first play mode. Second play mode program code is executed to cause the bingo player station 100 to operate in the second play mode. Play mode control program code is executed to cause bingo player station 100 to switch from the first play mode to the second play mode in response to the trigger event, and to cause the bingo player station to switch from the second play mode to the first play mode in response to a return event. All of this program code may be executed by processor 205 associated with the bingo player station shown in FIG. 2. In this case, processor 205 represents the presentation controller included in the invention. As indicated previously however, the invention is not limited to a presentation controller comprising a general purpose processing device, and is not limited to a presentation controller implemented at the bingo player station. Rather, the functions of the presentation controller described above particularly in connection with FIG. 3, may be performed at a processing device remote from the bingo player station. For example, local area server 200 or central server 201 shown in FIG. 2 may represent the presentation controller according to some preferred forms of the invention. The presentation controller functions may also be split between multiple processing devices within the scope of the present invention.

As discussed above, the present bingo gaming apparatus and method relies on a result controller for identifying a pattern matched in a bingo game to select a result for the player in the bingo game. However, the present invention is not limited to any particular arrangement for the result controller. As discussed above in connection with FIG. 2, the result controller for identifying a bingo pattern for a given bingo game play may be performed by a centralized processing device such as local area server 200 or central server 201. Further details on one preferred system for conducting a bingo game in a network setting with centralized bingo pattern identification are set out in U.S. Patent Application Publication No. 2004-0152499-A1, the entire content of which is incorporated herein by this reference. Other forms of bingo gaming systems in which the present invention may be used may include a result controller implemented with a processing device at the bingo player station such as bingo player station 100 in FIGS. 1 and 2. For example, processing device 205 at the player station may be programmed or otherwise adapted to match the bingo designations called in the bingo game with the bingo card/card representation for a given bingo game play initiated through the bingo player station, and to identify any resulting pattern of matched locations at the end of the bingo game. Thus, processing device 205 may be employed as the result controller in some implementations of the invention. Regardless of specifically where in the bingo gaming system the pattern identification occurs, this pattern identification may be accomplished in any suitable fashion within the scope of the invention. Computerized or otherwise automated bingo pattern matching arrangements are well known in the field of bingo gaming systems and will not be disclosed here since the operation of such arrangements forms no part of the present invention.

As used herein, whether in the above description or the following claims, the terms "comprising," "including," "carrying," "having," "containing," "involving," and the like are to be understood to be open-ended, that is, to mean including but not limited to. Only the transitional phrases "consisting of" and "consisting essentially of," respectively, shall be considered exclusionary transitional phrases, as set forth, with respect to claims, in the United States Patent Office Manual of Patent Examining Procedures (Eighth Edition, August 2001 as revised October 2005), Section 2111.03.

Any use of ordinal terms such as "first," "second," "third," etc., in the claims to modify a claim element does not by itself connote any priority, precedence, or order of one claim element over another, or the temporal order in which acts of a method are performed. Rather, unless specifically stated otherwise, such ordinal terms are used merely as labels to distinguish one claim element having a certain name from another element having a same name (but for use of the ordinal term).

The above described preferred embodiments are intended to illustrate the principles of the invention, but not to limit the scope of the invention. Various other embodiments and modifications to these preferred embodiments may be made by those skilled in the art without departing from the scope of the present invention.

The invention claimed is:

1. A method including:

(a) operating a bingo player station in a first play mode in which a result value for a respective primary game bingo game play initiated through the bingo player station is assigned according to a first pattern list, the first pattern list including a number of first result levels with each first result level corresponding to a respective set of one or more bingo patterns, to one or more first result indicators, and to a respective result value;

(b) in response to detecting a trigger event signal generated by an electronic processing device, switching the bingo player station from the first play mode to a second play mode;

(c) operating the bingo player station in the second play mode in which a result value for a respective primary game bingo game play initiated through the bingo player station is assigned according to a second pattern list which is different from the first pattern list, the second pattern list including a number of second result levels with each second result level corresponding to a respective set of one or more bingo patterns, to one or more second result indicators, and to a respective result value, wherein (i) the second pattern list includes at least one shared bingo pattern also in the first pattern list, (ii) the shared bingo pattern corresponds to a result value in the first pattern list associated with a first positive payout to the player, and (iii) the shared bingo pattern corresponds to a higher result value in the second pattern list associated with a second positive payout to the player, the second positive payout being higher than the first positive payout; and (d) in response to a return event signal generated by an electronic processing device, switching the bingo player station from the second play mode to the first play mode.

2. The method of claim 1 wherein the trigger event includes a series of consecutive winning bingo game plays at the bingo player station.

3. The method of claim 1 wherein operating the bingo player station in the first play mode includes producing first play mode graphics at the bingo player station and wherein operating the bingo player station in the second play mode includes producing second play mode graphics at the bingo player station, the second play mode graphics being different from the first play mode graphics, but sharing one or more graphic elements.

4. The method of claim 1 wherein switching from the first play mode to the second play mode includes changing from a first group of graphic symbols for showing a respective outcome for each respective bingo game play to a second group of graphic symbols for showing a respective outcome for each respective bingo game play, the second group of graphic symbols including at least one graphic symbol not included in the first group of graphic symbols.

5. The method of claim 1 wherein the return event includes a losing result for a respective bingo game play initiated through the bingo player station while the bingo player station is in the second play mode.

6. The method of claim 1 wherein the number of first result levels is equal to the number of second result levels.

7. The method of claim 1 wherein the number of first result levels is unequal to the number of second result levels.

8. The method of claim 1 wherein one first result level included in the first pattern list corresponds to a respective second result level included in the second pattern list to form a corresponding pair of result levels each associated with a common result value, and wherein each result level of the corresponding pair of result levels corresponds to a different set of one or more bingo patterns.

9. A bingo gaming apparatus including:

(a) a display device;

(b) a player input device;

(c) a presentation controller, the presentation controller for (i) applying a first pattern list to assign a result value for a respective primary game bingo game play initiated through the player input device when the bingo gaming apparatus is in a first play mode, the first pattern list including a number of first result levels with each first result level corresponding to a respective set of one or more bingo patterns, to a respective set of one or more first result indicators, and to a respective result value, (ii) applying a second pattern list which is different from the first pattern list to assign a result value for a respective primary game bingo game play initiated through the player input device when the bingo gaming apparatus is in a second play mode, the second pattern list including a number of second result levels with each second result level corresponding to a respective set of one or more bingo patterns, to a respective set of one or more second result indicators, and to a respective result value, wherein the second pattern list includes at least one shared bingo pattern also in the first pattern list, the shared bingo pattern corresponds to a lower positive payout in the first pattern list and a higher positive payout in the second pattern list; and (iii) causing an electronic processing device to selectively switch from the first play mode to the second play mode and from the second play mode back to the first play mode; and (d) a display controller for directing the display device to produce a respective result indicator for each respective bingo game play initiated through the player input device.

10. The bingo gaming apparatus of claim 9 wherein the first result indicators and the second result indicators each include a set of two or more reel symbols aligned along a payline.

11. The bingo gaming apparatus of claim 9 wherein the presentation controller is implemented with a processing device located remotely from a bingo player station that includes the display device and player input device.

12. The bingo gaming apparatus of claim 9 wherein the presentation controller is implemented with a first processing device located at a bingo player station that includes the display device and player input device.

13. The bingo gaming apparatus of claim 9 wherein the number of first result levels is equal to the number of second result levels.

14. The bingo gaming apparatus of claim 9 wherein the number of first result levels is unequal to the number of second result levels.

15. The bingo gaming apparatus of claim 11 wherein one first result level included in the first pattern list corresponds to a respective second result level included in the second pattern list to form a corresponding pair of result levels each associated with a common result value, and wherein each result level of the corresponding pair of result levels corresponds to a different set of one or more bingo patterns.

16. A program product embodied in one or more computer readable media, the program product including:

(a) first play mode program code executable to cause a bingo player station to operate in a first play mode in which a result value for each respective primary game bingo game play initiated through the bingo player station is assigned according to a first pattern list, the first pattern list including a number of first result levels with each first result level corresponding to a respective set of one or more bingo patterns, to a respective set of one or more first result indicators, and to a respective result value;

(b) second play mode program code executable to cause the bingo player station to operate in a second play mode in which a result value for each respective primary game bingo game play initiated through the bingo player station is assigned according to a second pattern list which is different from the first pattern list, the second pattern list including a number of second result levels with each second result level corresponding to a respective set of one or more bingo patterns, to a respective set of one or more second result indicators, and to a respective result value, wherein the second pattern list includes at least one shared bingo pattern also in the first pattern list, the shared bingo pattern corresponds to a lower positive payout in the first pattern list and a higher positive payout in the second pattern list; and (c) play mode control program code executable to cause the bingo player station to switch from the first play mode to the second play mode in response to a trigger event signal and to cause the bingo player station to switch from the second play mode to the first play mode in response to a return event signal, wherein the trigger event signal and return event signal are initiated by an electronic processing device and respectively indicate a trigger event and a return event at the bingo player station.

17. The program product of claim 16 wherein the first result indicators and the second result indicators each include a set of two or more reel symbols aligned along a payline.

18. The program product of claim 16 wherein the number of first result levels is equal to the number of second result levels.

19. The program product of claim 16 wherein the number of first result levels is unequal to the number of second result levels.

20. The program product of claim 17 wherein one first result level included in the first pattern list corresponds to a respective second result level included in the second pattern list to form a corresponding pair of result levels each associated with a common result value, and wherein each result level of the corresponding pair of result levels corresponds to a different set of one or more bingo patterns.

21. A gaming method including the steps of:

receiving a first wager to initiate a wagering game;

determining a first game outcome using coding executed by a processor, the first game outcome being one of a set of possible first game outcomes of a first game, the set of possible first game outcomes of a first game, the set of possible first game outcomes corresponding to a first distribution of possible awards;

determining a second game outcome associated with a corresponding award of the first game outcome, the second game being one of a set of possible game outcomes of a second game, the second game being different from the first game, wherein (i) the set of possible game outcomes of the second game includes at least one shared pattern also in the set of possible game outcomes of the first game, (ii) the shared pattern corresponds to a positive award to the player in the set of possible game outcomes of the first game, and (iii) the shared pattern corresponds to a higher positive award to the player in the set of possible game outcomes of the second game than in the set of possible game outcomes of the first game;

generating a game presentation of the second game viewable by a first player;

awarding the player with the corresponding award; and, receiving a subsequent wager to subsequently initiate the wagering game;

determining a subsequent corresponding award associated with a subsequent first game outcome wherein the set of possible first game outcomes are associated with a second distribution of possible awards different from the first distribution of possible awards.

22. A gaming method as in claim 21, the step of subsequently initiating the wagering game including:

determining a subsequent first game outcome;

determining a subsequent second game outcome associated with the subsequent corresponding award associated with the subsequent first game outcome;

generating a subsequent game presentation of the second game that is viewable by the first or another player; and awarding the player with the subsequent corresponding award.

23. A gaming method as in claim 21, the step of determining a first game outcome includes the step of determining the outcome of a bingo game, the first game comprising a bingo game.

24. A gaming method as in claim 23, the step of determining the outcome of a set of reels, the second game comprising a reel game using either a set of electromechanical reels or a set of simulated video reels.

25. A gaming method as in claim 23, the step of determining the outcome of a wheel and indicator, the second game comprising a wheel game.

* * * * *